US006171081B1

(12) United States Patent
Nakajima et al.

(10) Patent No.: US 6,171,081 B1
(45) Date of Patent: Jan. 9, 2001

(54) FUEL PUMP ASSEMBLY

(75) Inventors: Youichi Nakajima, Sendai (JP); Takuya Oouchi, Watari-gun (JP)

(73) Assignee: Keihin Corporation, Tokyo (JP)

( * ) Notice: Under 35 U.S.C. 154(b), the term of this patent shall be extended for 0 days.

(21) Appl. No.: 09/134,095

(22) Filed: Aug. 14, 1997

(30) Foreign Application Priority Data

Feb. 17, 1998 (JP) ..... 10-052862

(51) Int. Cl.[7] ..... F04B 19/00
(52) U.S. Cl. ..... 417/470; 417/437
(58) Field of Search ..... 417/470, 471, 417/437, 395, 44.9

(56) References Cited

U.S. PATENT DOCUMENTS 3,301,195 * 1/1967 Streeter ..... 417/471
3,841,796 * 10/1974 Schlanzky ..... 417/274
4,917,148 * 4/1990 Tamamori ..... 137/596.18
5,113,831 * 5/1992 Grant ..... 123/457

* cited by examiner

*Primary Examiner*—Charles G. Freay
*Assistant Examiner*—Michael K. Gray
(74) *Attorney, Agent, or Firm*—Pillsbury Madison & Sutro Intellectual Property Gro

(57) ABSTRACT

A fuel pump assembly is capable of improving follow-up ability of a push rod relative to an eccentric cam by increasing a spring force of a push rod spring, without increasing a size of the fuel pump assembly. The fuel pump assembly comprises a lower pump body and an upper pump body. A pump diaphragm clamped between the lower pump body and the upper pump body defines a pump chamber and an operation chamber. A diaphragm rod is integrally mounted on the pump diaphragm and is slidably supported on the lower pump body. The push rod is supported for movement along a longitudinal direction of the diaphragm rod. The push rod is movably supported within a push rod guide hole opened downwardly in the lower pump body and has a lower end extended downwardly from the lower pump body. The push rod spring is disposed within the push rod guide hole in compressed fashion and is arranged on the outer periphery of the diaphragm rod. The push rod spring is engaged with an upper bottom portion of the push rod guide hole at an upper end and is engaged with the push rod at a lower end for resiliently pushing the push rod toward a pin mounted on the diaphragm rod for engagement. A diaphragm spring is disposed within the operation chamber in compressed fashion and depresses the pump diaphragm toward the pump chamber. The push rod spring consists of a first push rod spring having a larger diameter and a second push rod spring having a smaller diameter. The respective lower ends of the first push rod spring and the second push rod spring are engaged with a bottom portion of an upwardly opened recessed portion of the push rod and the respective upper ends thereof are engaged with the upper bottom portion of the push rod guide hole.

3 Claims, 2 Drawing Sheets

FUEL PUMP ASSEMBLY

BACKGROUND OF THE INVENTION

1. Field of the Invention

The present invention relates to a fuel pump assembly sucking a fuel in a fuel tank and pressurizing the sucked fuel for supplying to a fuel supply system associated with an internal combustion engine. More particularly, the invention relates to a fuel pump assembly performing pumping operation by reciprocally driving a push rod or a diaphragm by means of an eccentric cam fixedly mounted on a camshaft of an internal combustion engine and increasing and decreasing a volume of a pumping chamber through a pump diaphragm by reciprocal motion of the push rod or the diaphragm.

2. Description of the Related Art

The conventional fuel pump assembly is illustrated in FIG. 2. In FIG. 2, the reference numeral 1 denotes a lower pump body, an upper end 1A of which forms a flat surface. A recessed portion 1B defining an operation chamber and opening to the upper end 1A is defined in the lower pump body 1. Also, a downwardly opened push rod guide bore 1E with an upper bottom portion 1D located at higher position than a lower end 1C, is formed in the lower pump body 1. The reference numeral 2 denotes an upper pump body arranged on the upper end 1A of the lower pump body 1. A recessed portion 2B for defining a pump chamber is defined in the upper pump body 2 and is located in opposition to the recessed portion 1B when the upper pump body 2 is assembled with the lower pump body. Also, a recessed portion 2D for defining an inflow chamber and a recessed portion 2E for defining a discharge chamber, both opening to an upper end 2C of the upper pump body 2, are formed. The recessed portion 2D for defining the inflow chamber and the recessed portion 2E for defining the discharge chamber are separated by a partitioning wall 2F. The recessed portion 2D for defining the inflow chamber and the recessed portion 2E for defining the discharge chamber are communicated through an inflow hole 2G. The recessed portion 2B for defining the pump chamber and the recessed portion 2E for defining the discharge chamber are communicated through a discharge hole 2H. The reference numeral 3 denotes a suction side check valve for opening and closing the inflow hole 2G. The reference numeral 4 denotes a discharge side check valve for opening and closing the discharge hole 2H. The reference numeral 5 denotes a pump cover arranged on an upper end 2C of the upper pump body 2. The lower end 5A of the pump cover 5 defines a recessed portion 5B defining a first regulator chamber opposing the recessed portion 2D for defining the inflow chamber and a recessed portion 5C defining a second regulator chamber opposing the recessed portion 2E for defining the discharge chamber, are formed in the pump cover 5. The reference numeral 5D denotes a partitioning wall separating the recessed portion 5B defining the first regulator chamber and the recessed portion 5C defining the second regulator chamber.

Then, on the upper end 1A of the lower pump body 1, the upper pump body 2 is arranged, Also, on the upper end 2C of the upper pump body 2, the pump cover is arranged. The lower pump body 1, the upper pump body 2 and the pump cover 5 are fixedly assembled by means of bolts 6. At this time, between the upper end 1A of the lower pump body 1 and the lower end 2A of the upper pump body 2, a pump diaphragm 7 is clamped. Similarly, between the upper end 2C of the upper pump body 2 and the lower end 5A of the pump cover 5, a regulator diaphragm 8 is arranged. By the pump diaphragm 7 and the recessed portion 1B defining the operation chamber of the lower pump body 1, an operation chamber A is defined. Also, by the pump diaphragm 7 and the recessed portion 2B for defining the pump chamber of the upper pump body 2, a pump chamber P is defined. On the other hand, by the regulator diaphragm 8 and the recessed portion 2D for defining the inflow chamber of the upper pump body 2, an inflow chamber B is defined, and by the regulator diaphragm 8 and the recessed portion 2E for defining the discharge chamber, the discharge chamber C is defined. The inflow chamber B and the discharge chamber C are separated by the partitioning wall 2F. Also, by the regulator diaphragm 8 and the recessed portion 5B for defining the first regulator chamber of the pump cover 5, a first regulator chamber D is defined and by the regulator diaphragm 8 and the recessed portion 5B for defining the second regulator chamber of the pump cover 5, a second regulator chamber E is defined. The first regulator chamber D and the second regulator chamber E are separated by the partitioning wall 5D. Also, the first regulator chamber D is in opposition to the inflow chamber B via the regulator diaphragm 8, and the second regulator chamber E is in opposition to the discharge chamber C via the regulator diaphragm 8.

On the pump diaphragm 7, a diaphragm rod 9 is integrally mounted via upper and lower retainers. The diaphragm rod 9 is arranged within the rod guide hole 1G extending from the operation chamber A to the push rod guide hole 1E in movable fashion. The lower end is located in the vicinity of the lower end of the push rod guide hole 1E.

The reference numeral 10 denotes a cylindrical push rod slidably supported in the, push rod guide hole 1E at an outer diametrical portion 10A and is slidably supported on the diaphragm rod 9 at the inner diametrical portion 10B. On the push rod 10, an upwardly opened recessed portion 10D opened upwardly and having a bottom portion 10C and an elongated groove 10E cut out from the inner diametrical portion 10B to the outer diametrical portion 10A. Within the elongated groove 10E, a pin 11 is mounted in the vicinity of the lower end of the diaphragm rod 9.

The reference numeral 12 denotes a push rod spring disposed within the push rod guide hole 1E in compressed position. The upper end of the push rod spring 12 is engaged with an upper bottom portion 1D of the push rod guide hole 1E. The lower end is engaged with the bottom portion 10C of the upwardly opened recessed portion 10D of the push rod 10. The push rod spring 12 downwardly depresses the push rod 10 to engage the push rod 10 with the pin 11. On the other hand, within the operation chamber A, a diaphragm spring 13 is disposed within compressed position. The upper end of the diaphragm spring 13 is engaged via the retainer, and the lower end of the diaphragm spring 13 is engaged with the recessed portion 1B of the operation chamber. The diaphragm spring 13 depresses the pump diaphragm 9 toward the pump chamber P.

Then, a relationship of spring forces between the push rod spring 12 and the diaphragm spring 13 is set, in the condition illustrated in FIG. 2, such that a spring force of the push rod spring 12 is set greater than a spring force of the diaphragm spring 13. Then, when the fuel pump arrangement is installed on a not shown internal combustion engine, the lower end of the push rod 10 projecting downwardly from the lower end 1C of the lower pump body 1 is arranged in contact with the eccentric cam mounted on the camshaft (camshaft and eccentric cam are not shown).

In the construction set forth above, when the engine is driven and a high profile portion of the eccentric cam comes into contact with the push rod 10, the push rod 10 is moved upwardly against a spring force of the push rod spring 12 to reduce a volume of the pump chamber P of the pump diaphragm 7. By this, the suction side check valve 3 closes the inflow hole 2G and the discharge side check valve 4 opens the discharge hole 2H. By this, the fuel stored in the pump chamber P is pressurized and discharged to the discharge chamber C and then supplied to the fuel supply system via a not shown duel discharge passage. Next, when the low profile portion of the eccentric cam comes into contact with the push rod 10, the push rod 10 is depressed downwardly toward the low profile portion of the eccentric cam by the spring force of the push rod spring 12. Movement of the push rod 10 is transmitted to the diaphragm rod 9 via the pin 11 to increase the volume of the pump chamber P by shifting the pump diaphragm 7 downwardly. Then, tie suction side check valve 3 opens the inflow hole 2G and the discharge side check valve 4 closes the discharge hole 2H. By this, the fuel in a not shown fuel reservoir, such as a fuel tank, is sucked into the pump chamber P via the inflow hole 2G. Then, by sequential rotation of the eccentric cam, suction of the fuel into the pump chamber P and discharging therefrom is sequentially performed. Thus, the fuel stored in the fuel reservoir can be continuously supplied to the fuel supply system from the fuel pump assembly.

In such fuel pump assembly, movement of the diaphragm rod 9 including the push rod 10 and the pump diaphragm 7 toward the side for increasing the volume of the pump chamber P (in other words, movement downwardly in the drawing) depends on the spring force of the push rod spring 12, as set froth above. In order to enhance follow-up ability of the push rod 10 when rotation speed of the eccentric cam is significantly increased, it is typical to increase the spring force of the push rod spring 12. In order to increase the spring force of the push rod spring 12, it is typical to increase external diameter of the push rod spring 12. If the external diameter of the push rod spring 12 is increased, it becomes necessary to increase diameter of the push rod guide hole 1E to inherently cause increasing of size of the cylindrical portion of the lower pump body 1. Thus, freedom in installing on the engine can be degraded.

SUMMARY OF THE INVENTION

The present invention has been worked out in view of the drawback set forth above. Therefore, it is an object of the present invention to provide a fuel pump assembly which can make the spring force of a push rod spring greater without increasing of size beyond the conventional fuel pump assembly and can improve follow-up ability of an eccentric cam of the push rod.

In order to accomplish the above-mentioned and other objects, a fuel pump assembly comprises:

a lower pump body;

an upper pump body;

a pump diaphragm clamped between the lower pump body and the upper pump body and defining a pump chamber and an operation chamber;

a diaphragm rod integrally mounted on the pump diaphragm and being slidably supported on the lower pump body;

a push rod movably supported along a longitudinal direction of the diaphragm rod, movably supported within a push rod guide hole opened downwardly in the lower pump body, and having a lower end extended downwardly from the lower pump body;

a push rod spring disposed within the push rod guide hole in compressed fashion, arranged on the outer periphery of the diaphragm rod, engaged with the upper bottom portion of the push rod guide hole at an upper end and engaged with the push rod at a lower end, for resiliently pushing the push rod toward a pin mounted on the diaphragm rod for engagement;

a diaphragm spring disposed within the operation chamber in compressed fashion and depressing the pump diaphragm toward the pump chamber; and the push rod spring being consisted of a first push rod spring having a larger diameter and a second push rod spring having a smaller diameter, an outer peripheral portion of the first push rod spring being guided by an inner periphery of the upwardly opened recessed portion and an outer peripheral portion of the second push rod being guided by an inner periphery provided in the upper bottom portion of the push rod guide hole.

In the preferred construction, the operation chamber and the push rod guide hole are communicated by a first communication hole, and the push guide hole being communicated with atmosphere through a second communication hole formed along the inner periphery of the push rod guide hole and opening toward the lower end of the lower pump body.

As set forth above, by consisting the push rod spring with the first push rod spring and the second push rod spring in a form of double-fold spring, the spring force of the push rod spring can be set higher without increasing size of the fuel pump assembly to achieve improvement in follow-up ability of the push rod with respect to the eccentric cam.

Ventilation of the operation chamber is performed through the first and second communication holes. Ventilation in the push rod guide hole is performed by the second communication hole. Particularly, since the second communication hole performs ventilation of the operation chamber and the push rod guide hole in common, ventilation structure becomes quite simple.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessarily obscuring the present invention.

Figure 1:
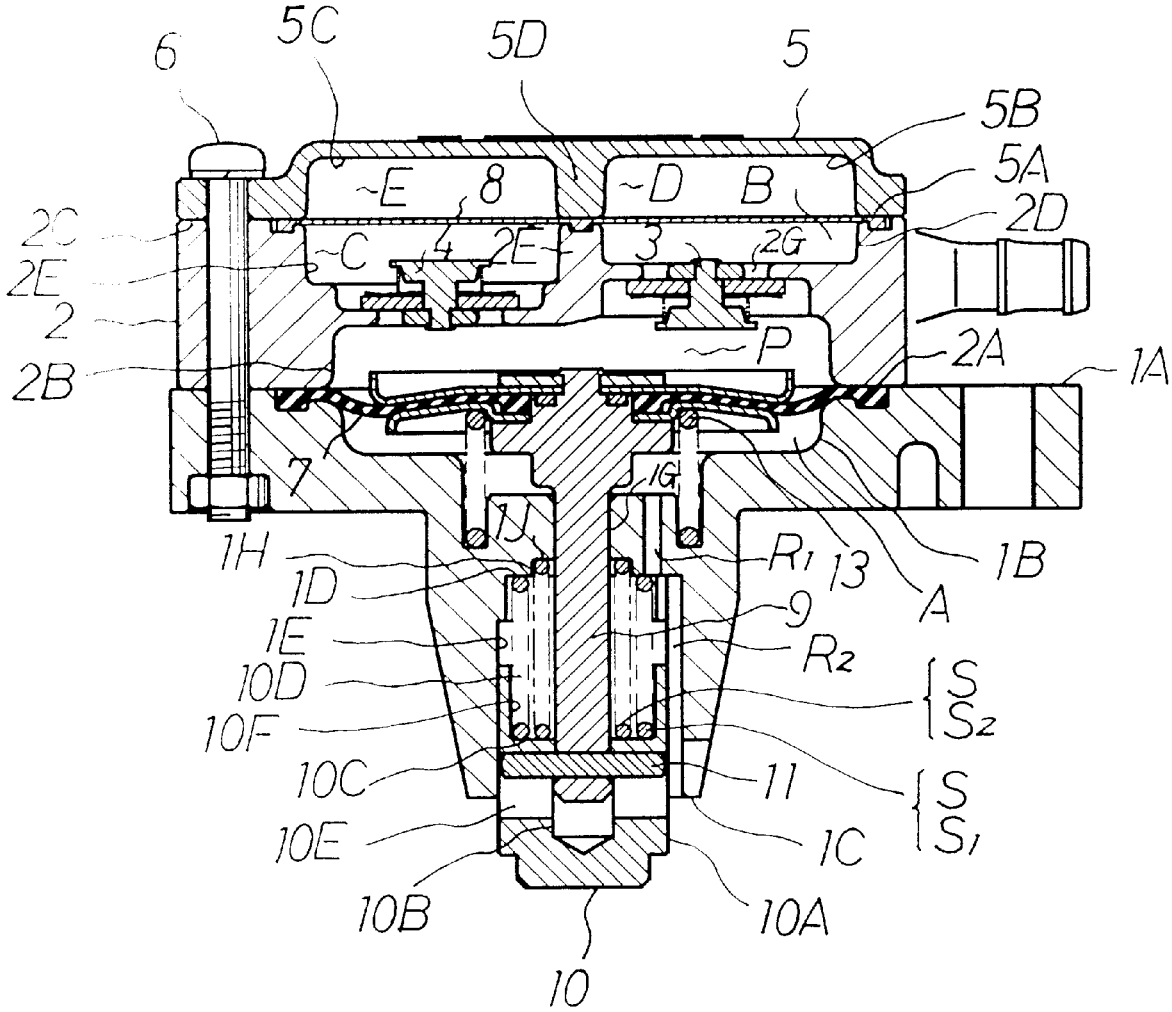
FIG. 1 is a longitudinal section showing one embodiment of a fuel pump assembly according to the present invention and FIG. 2 is a longitudinal section showing a prior art fuel pump assembly.
Figure 2:
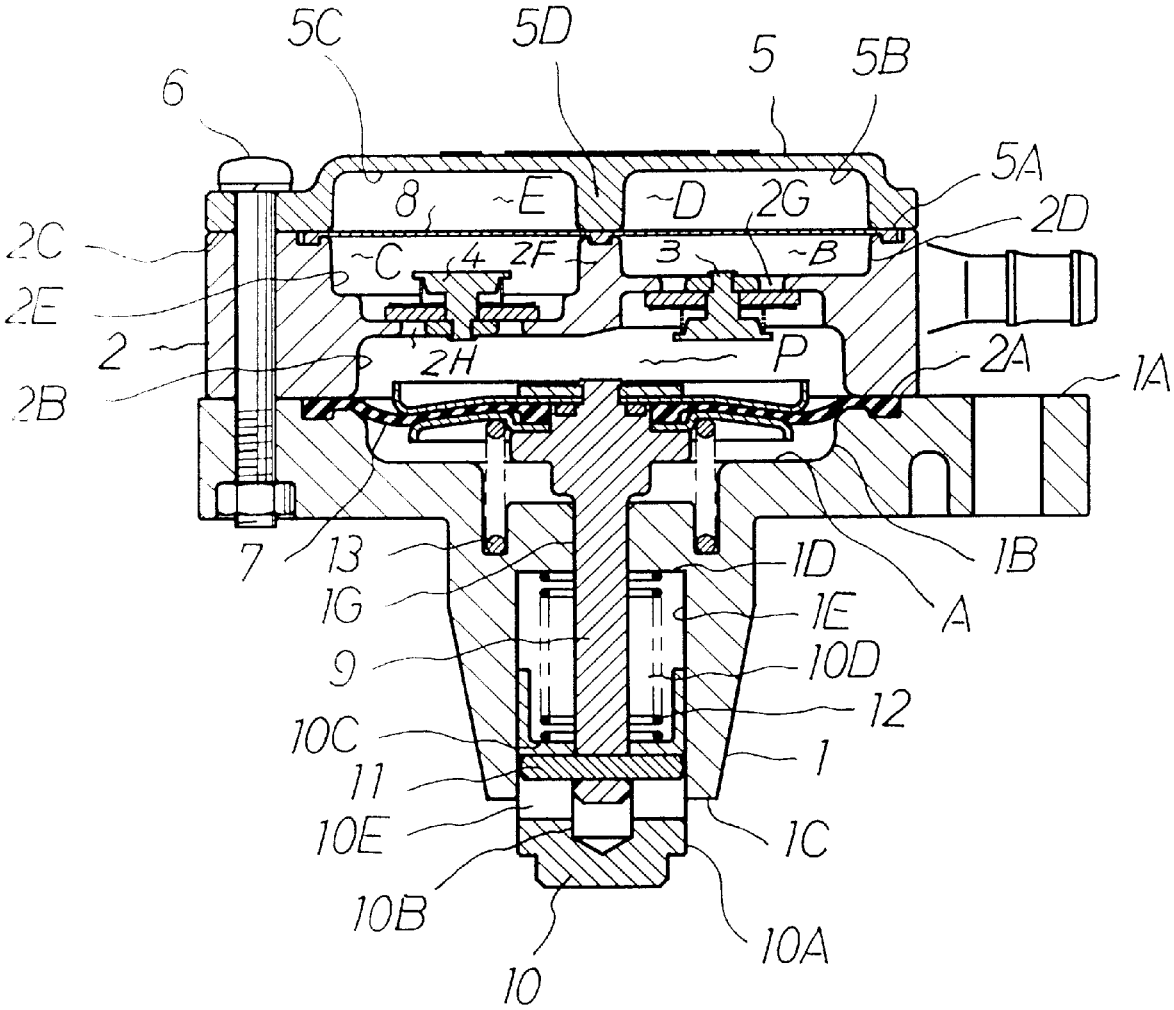

The preferred embodiment of a fuel pump assembly according to the present invention will be discussed with reference to FIG. 1. It should be noted that like elements to those in FIG. 2 will be identified by like reference numerals and detailed description thereof will be neglected for keeping the disclosure simple enough by avoiding redundant discussion so as to facilitate clear understanding of the present invention. The push rod spring S disposed within the push rod guide hole 1 in compressed form is formed as follow. The push rod spring S is constituted of a larger diameter coil form first push rod spring S1 and a smaller diameter coil form second push. rod spring S2.

The first push rod spring S1 is arranged within the upwardly opened recessed portion 10D with locating the outer periphery thereof along the inner peripheral surface 10F. The lower end of the first push rod spring S1 is engaged with the bottom portion 10C of the upwardly opened recessed portion 10D, and the upper end thereof is engaged to the upper bottom portion 1D of the push rod guide hole 1E. Here, "locating the outer periphery thereof along the inner peripheral surface 10F of the upwardly opened recessed portion 10D" means that the outer periphery of the first push rod spring is in contact with the inner peripheral surface or in spaced apart from the latter with a fine gap.

The second push rod spring S2 is disposed inside of the first push rod spring S1 and surrounds the outer periphery of the diaphragm rod 9. Namely, the outer diameter of the second push rod spring S2 is arranged inside of the first push rod spring. The lower end of the second push rod spring S2 is engaged with the bottom portion 10C of the upwardly opened recessed portion 10D and the upper end thereof is engaged with an upper bottom 1J of an inner wall 1H recessed in the upper bottom portion 1D of the push rod guide hole 1E. The external diameter of the upper end of the second push rod spring S2 is arranged along the inner wall portion 1H.

On the other hand, the operation chamber A and the push rod guide hole 1E are communicated with a first communication aperture R1. The lower side of the first communication aperture R1 opens to the upper bottom portion 1D of the push rod guide hole 1E.

On the other hand, on the inner wall of the push rod guide hole 1E, a groove serving as a second communication hole R2 extending in the vertical direction is formed. This groove opens along the longitudinal direction in the push rod guide hole 1E. The lower end of the groove opens to the lower end 1C of the lower pump body 1.

With the shown embodiment of the fuel pump assembly according to the present invention, since the first push rod spring S1 and the second push rod spring S2 are arranged in double-hold fashion within the push rod guide hole 1E without varying inner diameter of the push rod guide hole 1E, greater spring force can be provided for the push rod spring S without increasing the size of the lower pump body 1 (more particularly, corresponding to the external diameter portion of the push rod guide hole 1E). Thus, follow-up ability of the push rod 10 relative to the eccentric cam can be improved to increase a discharge amount of the fuel pump. In addition, generation of hammering noise on the eccentric cam can be restricted, Also, since it is not necessary to make the outer diameter of the push rod guide hole 1E, the fuel pump assembly will never become greater in size and thus will never degrade freedom in installation on the internal combustion engine. Furthermore, the fuel pump assembly according to the present invention achieves compatibility with the conventional fuel pump assembly to permit application without requiring any significant change. Furthermore, since the outer diameter of the first push rod spring S1 is guided by the inner peripheral wall lOF of the push rod guide hole 1E and the outer diameter of the second push spring S2 is guided by the inner wall 1H recessed in the upper bottom portion 1D, displacement of respective push rod springs S1 and S2 in the lateral direction will never occur. The push rod springs S1 and S2 will maintain their own positions thereof and will avoid the possible occurrence of interference. Accordingly, the spring force can be stably applied to the push rod to stably maintain discharge amount. In addition wearing of the first and second push rod springs S1 and S2 caused otherwise due to mutual contact therebetween, can be successfully avoided to permit stable application of the spring force on the push rod 10 over a long period.

On the other hand, by reciprocal movement of the push rod 10 within the push rod guide hole 1E, the volume in the push rod guide hole 1E is varied to cause variation of pressure within the push rod guide hole 1E. However, since the pressure variation can be absorbed by the second communication hole R2 formed in the inner wall of the push rod guide hole 1E, good reciprocal movement of the push rod can be achieved.

On the other hand, by reciprocal movement of the pump diaphragm 7, volume of the operation chamber A is varied to cause pressure variation in the operation chamber A. However, pressure variation can be absorbed by the push rod guide hole 1E and the second communication hole R2, reciprocal motion of the pump diaphragm 7 will never be affected by the pressure variation.

Furthermore, in the construction set forth above, since the second communication hole R2 is used as an opening to the outside of the first communication hole R1, simplification of a ventilation structure can be achieved.

Although the present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. A fuel pump assembly comprising:

a lower pump body;

an upper pump body;

a pump diaphragm clamped between said lower pump body and said upper pump body and defining a pump chamber and an operation chamber;

a diaphragm rod integrally mounted on said pump diaphragm and being slidably supported on said lower pump body;

a push rod supported for movement along a longitudinal direction of said diaphragm rod, said push rod being movably supported within a push rod guide hole opened downwardly in said lower pump body, and having a lower end extended downwardly from said lower pump body;

a push rod spring disposed within said push rod guide hole in compressed fashion, arranged on the outer periphery of said diaphragm rod, engaged with an upper bottom portion of said push rod guide hole at an upper end and engaged with said push rod at a lower end, for resiliently pushing said push rod toward a pin mounted on said diaphragm rod for engagement;

a diaphragm spring disposed within said operation chamber in compressed fashion and depressing said pump diaphragm toward said pump chamber; and said push rod spring comprising a first push rod spring having a larger diameter and a second push rod spring having a smaller diameter, respective lower ends of said first push rod spring and said second push rod spring being engaged with a bottom portion of an upwardly opened recessed portion of said push rod and respective upper ends thereof being engaged with the upper bottom portion of said push rod guide hole.

2. A fuel pump assembly according to claim 1, wherein said operation chamber and said push rod guide hole are communicated by a first communication hole, and said push rod guide hole being communicated with atmosphere through a second communication hole formed along the inner periphery of said push rod guide hole and opening toward the lower end of said lower pump body.

3. A fuel pump assembly according to claim 1, wherein an external diameter portion of said first push rod spring is guided by an inner peripheral wall of said upwardly opened recessed portion of said push rod, and an external diameter portion of said second push rod spring is guided by an inner peripheral wall provided in the upper bottom portion of said push rod guide hole.

* * * * *